US011913165B2

(12) United States Patent
Satharasinghe et al.

(10) Patent No.: US 11,913,165 B2
(45) Date of Patent: Feb. 27, 2024

(54) TEXTILE FABRIC-ELASTOMER COMPOSITE

(71) Applicant: MAS INNOVATION (PRIVATE) LIMITED, Battaramulla (LK)

(72) Inventors: Achala Sajeeva Satharasinghe, Battaramulla (LK); Madushi Hansika Medagedara, Battaramulla (LK); Dinushka Deshappriya, Battaramulla (LK); Bimal Cooray, Battaramulla (LK); Anushka Darshana, Battaramulla (LK); Nadeekha Michelle Leanage, Battaramulla (LK); Manoj Jayamal, Battaramulla (LK); Shashika Maduranga, Battaramulla (LK)

(73) Assignee: MAS INNOVATION (PRIVATE) LIMITED, Battaramulla (LK)

( * ) Notice: Subject to any disclaimer, the term of this patent is extended or adjusted under 35 U.S.C. 154(b) by 0 days.

(21) Appl. No.: 18/170,075

(22) Filed: Feb. 16, 2023

(65) Prior Publication Data

US 2023/0257932 A1 Aug. 17, 2023

(30) Foreign Application Priority Data

Feb. 16, 2022 (GB) ..... 2202060

(51) Int. Cl.
*D06M 15/693* (2006.01)

(52) U.S. Cl.
CPC ..... *D06M 15/693* (2013.01); *D06M 2200/50* (2013.01); *D10B 2401/061* (2013.01); *D10B 2501/00* (2013.01)

(58) Field of Classification Search
CPC ..... D06N 2203/066; D06N 3/128; D06M 15/643; C09D 183/04; D06P 1/5292; C04B 41/4961; B32B 27/12; B32B 25/10; C08L 83/04; C08J 2383/04
See application file for complete search history.

(56) References Cited

U.S. PATENT DOCUMENTS

| | | | | |
|---|---|---|---|---|
| 6,769,358 | B2 | 8/2004 | Jordan | |
| 10,555,568 | B1 * | 2/2020 | Walker-Baldwin | A42B 1/04 |
| 2005/0282453 | A1 * | 12/2005 | Jackson | D06N 3/128 427/334 |

(Continued)

FOREIGN PATENT DOCUMENTS

| | | | | |
|---|---|---|---|---|
| WO | WO-2010000887 | A1 * | 1/2010 | A41D 31/0077 |
| WO | 2014/049390 | A1 | 4/2014 | |

OTHER PUBLICATIONS

Espacenet translation of WO-2010000887-A1 (Year: 2010).*

*Primary Examiner* — Jeremy R Pierce
*Assistant Examiner* — Christine X Nisula
(74) *Attorney, Agent, or Firm* — Osha Bergman Watanabe & Burton LLP

(57) ABSTRACT

Disclosed herein is a composite material that is formed from a textile substrate having a surface, the textile substrate formed from a yarn, where the yarn is formed from a plurality of fibres or filaments, such that the yarn has a core region of fibres or filaments surrounded by a peripheral region of fibres or filaments; and a cured elastomeric material layer laid over the whole or part of the textile substrate surface, where the cured elastomeric material penetrates into the yarn and is attached to the fibres or filaments in the peripheral region of the yarn.

16 Claims, 1 Drawing Sheet

(56) References Cited

U.S. PATENT DOCUMENTS

| | | | | |
|---|---|---|---|---|
| 2013/0004747 | A1* | 1/2013 | Schwarz | D06N 7/0092 428/196 |
| 2018/0127903 | A1* | 5/2018 | Thatcher | A61F 9/06 |
| 2022/0401267 | A1* | 12/2022 | Teixeira Rangel | A61F 13/061 |

* cited by examiner

TEXTILE FABRIC-ELASTOMER COMPOSITE

FIELD OF INVENTION

This invention relates to a textile fabric-elastomer composite that is wash-durable, soft, breathable and drapable. It may be made by attaching an elastomeric coating of low-durometer hardness to the yarns of a suitable fabric.

BACKGROUND

The listing or discussion of a prior-published document in this specification should not necessarily be taken as an acknowledgement that the document is part of the state of the art or is common general knowledge.

In the field of textiles and apparel, a number of different techniques have been employed in an attempt to obtain a localised increase in the power and elastic modulus of garments.

Currently, elastomeric coatings and bonding films applied to fabrics to increase elastic modulus leave a continuous air-impermeable layer on the surface of the fabric which affects the flexibility, drapability, breathability and appearance of the fabric. Also the bulkiness of the applies area is significantly increased.

In one method, fabrics with different elastic modulus properties are joined together by stitching or gluing. This method is time consuming and suffers aesthetically and in its wearability, because the joints between the fabrics are visually and physically prominent, with the latter resulting in discomfort to the wearer.

In another method, the textile substrate is reinforced by laminating an elastomeric film on top of the fabric in the areas where increased power and elastic modulus is desired using an adhesive. In this method the area treated becomes non-breathable and bulky. In addition, a separate lamination process is necessary to provide the product.

Using a similar concept, a method that uses knitting enables one to create fabrics formed from multiple zones, with each of these zones having one or both different fabric structure and yarn combination, so as to provide different physical properties in each zone (e.g. different elastic moduli). This method may use jacquard knitting and/or jacquard weaving technology. However, this process requires sophisticated machinery. Similar products may be made by employing a thermoplastic yarn in combination with ground yarns, using either jacquard knitting or jacquard weaving technology in the areas where increased elastic modulus is desired. Once the knitting is complete, the fabric is subjected to heat treatment where the thermoplastic yarn melts within the fabric structure to increase the elastic modulus in the desired areas. In this method, the elastic modulus is increased by reduction of stretch, which can restrict the wearer's freedom of movement. Although this method does not impair breathability, it requires sophisticated machinery to produce and also makes the garment heavier and thicker in the areas of higher elastic modulus. In both the above cases, since the change of elastic modulus is done at an earlier stage of the garment manufacturing value stream, which is in the fabric manufacturing stage, it dramatically reduces the process flexibility and hence the ability to respond to the needs to customers who may need to make alterations to their desired properties at the last minute.

With the recent trends in the global apparel and textile industry there is a high emphasis for enhancing performance without compromising on comfort related properties like air permeability, moisture permeability, drapability and haptic properties as well as aesthetic properties. For certain applications like lingerie and sportswear comfort is of utmost importance along while maintaining aesthetic properties, in addition to performance. In cases discussed in prior art, the areas of elastic modulus enhancement is bulky and has different texture, friction levels and drapability properties to that of the base fabric, which affects the comfort properties. The bulkiness not only impairs the comfort but also the aesthetic value of the product. The aim of the present disclosure is to address the aforementioned disadvantages, by maintaining continuity of comfort and aesthetic properties throughout the fabric, while maintaining physical dimensions more specifically the thickness of the fabric where the enhancement of elastic modulus is desired.

WO 2014/049390A1 relates to a textile assembly with air and water vapour permeable elastomeric coating. This patent publication tries to address the above-mentioned problems by impregnating a low viscosity elastomer (below 20,000 centipoise) into the fabric. However, due to the low viscosity, the elastomer fully penetrates the yarns (i.e. fully penetrates into the interior of the yarns), thereby increasing the stiffness of the material, which affects its flexibility and drapability. Also, due to the weak binding points created at the yarn intersection points the mechanical bonds that have been formed easily break during elongation, which significantly reduces the increase in modulus after only a few elongation cycles.

U.S. Pat. No. 6,769,358 discloses that one can apply a fabric-reinforcing adhesive coat to a single-layer textile fabric in such a way that the length of adhesive applied is structured in such a way that it substantially corresponds to the later outer contour of the item of clothing. This allows one to generate a hem-free edge for the item of clothing. While this process allows one to create the edge of the garment by simply cutting within the reinforced area, it is noted that the manner of laying down the adhesive reduces the breathability of the fabric in the area to which it is applied. Additionally, the adhesive used here is one that uses a low viscosity, such that it completely penetrates through the fabric to form a unified fabric/adhesive layer. As such, the resulting product also suffers from the issues mentioned above for WO 2014/049390A1.

Thus, there remains a need for improved products that overcome some or all of the problems identified above.

SUMMARY OF INVENTION

Some or all of the problems identified above are solved the product and methods described in the following numbered clauses, which relate to aspects and embodiments of the invention.

1. A composite material comprising:
   - a textile substrate having a surface, the textile substrate formed from a yarn, where the yarn is formed from a plurality of fibres or filaments, such that the yarn has a core region of fibres or filaments surrounded by a peripheral region of fibres or filaments; and
   - a cured elastomeric material layer laid over the whole or part of the textile substrate surface, wherein:
   - the cured elastomeric material penetrates into the yarn and is attached to the fibres or filaments in the peripheral region of the yarn; and
   - the cured elastomeric material is not attached to the fibres or filaments in the core region of the yarn.

2. The composite material according to claim 1, wherein the elastomeric material has a pre-cured viscosity of from 60,000 to 120,000 centipoise, such as 92,000 centipoise, at 20° C., optionally wherein the elastomeric material is a blend of two or more elastomers (e.g. the elastomer is formed from blend of a first and second elastomer, where:

the first elastomer has: a pre-cured viscosity of from 100,000 to 300,000 centipoise, such as from 150,000 to 250,000 centipoise, such as about 180,000 centipoise, at a temperature of 20° C.; and the second elastomer has: a pre-cured viscosity of from 1,000 to 50,000 centipoise, such as about 3,900 centipoise, at a temperature of 20° C.

3. The composite material according to Clause 1 or Clause 2, wherein the cured elastomeric material has one or more of the following properties when cured:

(a) a Durometer shore A hardness of from 3 to 15, such as about 8;

(b) a tensile strength of from 1 to 8 Mpa, such as about 3 Mpa; and (c) an elongation to break of from 500 to 1600%, such as about 1100%.

4. The composite material according to any one of the preceding clauses, wherein the elastomeric material is a silicone elastomer.

5. The composite material according to Clause 4, wherein the silicone elastomer is a blend of two or more silicone elastomers.

6. The composite material according to Clause 4 or Clause 5, wherein the silicone elastomer has a pre-cured viscosity of from 60,000 to 120,000 centipoise, such as 92,000 centipoise, at 20° C.

7. The composite material according to any one of Clauses 4 to 6, wherein the silicone elastomer is formed from blend of a first and second silicone elastomer, where:

the first silicone elastomer has: a pre-cured viscosity of from 100,000 to 300,000 centipoise, such as from 150,000 to 250,000 centipoise, such as about 180,000 centipoise, at a temperature of 20° C.; a Durometer shore A hardness of from 5 to 20, such as from 7 to 15, such as about 10; an elongation to break of from 500 to 2000%, such as from 1000 to 1500%; and a tensile strength of from 1 to 8 MPa, such as from 3.5 to 5 MPa; and the second silicone elastomer has: a pre-cured viscosity of from 1,000 to 50,000 centipoise, such as about 3,900 centipoise, at a temperature of 20° C.; an Asker C hardness of from 10 to 25, such as about 17; an elongation to break of from 200 to 1500%, such as from 500 to 1,000%, such as about 750%; and a tensile strength of from 1 to 6 MPa, such as from 1.9 to 4 MPa.

8. The composite material according to Clause 7, wherein the weight:weight ratio of the first silicone elastomer to the second silicone elastomer is from 1:10 to 10:1, such as from 1:5 to 5:1, such as from 1:3 to 3:1, such as from 1:2 to 2:1, such as about 1:1.

9. The composite material according to any one of the preceding claims, wherein a portion of the composite material formed from the textile substrate and the cured elastomeric material layer that has not been subject to washing has a power that increases from 20 to 500%, such as from 85 to 240%, such as from 91 to 232% compared to the power of the textile substrate, optionally wherein a portion of the composite material formed from the textile substrate and the cured elastomeric material layer that has undergone washing to simulate at least 25 wash and dry cycles has a power that increases from 20 to 500%, such as from 80 to 475%, such as from 85 to 230%, such as from 91 to 221% compared to the power of the textile substrate.

10. The composite material according to any one of the preceding clauses, wherein the cured elastomeric material layer includes a region abutting or adjacent to a peripheral edge portion of the textile substrate surface.

11. The composite material according to any one of the preceding clauses, wherein the cured elastomeric material layer is laid as a pattern over part of the textile substrate surface.

12. The composite material according to any one of the preceding clauses, wherein the yarns used in the textile substrate comprises one or more materials selected from an animal fibre (e.g. wool), and, more particularly, a polyamide (e.g. a nylon), spandex, elastane, polyester, and a cellulosic material (e.g. cellulose or a cellulose derivative).

13. The composite material according to any one of the preceding clauses, wherein the textile substrate is a knitted fabric or a woven fabric, optionally wherein:

(a) the knitted fabric is formed using one or more of single Jersey, double Jersey, tricot, and interlock stitching; or (b) the woven fabric has a stretchability of up to 50%.

14. A garment comprising a composite material as described in any one of Clauses 1 to 13.

15. The garment according to Clause 14, wherein the garment has a raw-cut edge along at least one periphery of the garment and the composite material is present along the length of the at least one periphery with the raw-cut edge.

16. The garment according to Clause 14 or Clause 15, wherein the composite material is placed on a surface intended to be in direct contact with a wearer's skin, and is configured to grip the wearer without tackiness and substantially prevent the garment from moving.

17. A method of manufacturing a composite material according to any one of Clauses 1 to 13, the method comprising:

(a) providing a textile substrate having a surface, the textile substrate formed from a yarn, where the yarn is formed from a plurality of fibres or filaments, such that the yarn has a core region of fibres or filaments surrounded by a peripheral region of fibres or filaments; and (b) applying an elastomeric material to the surface of the textile substrate and curing the elastomeric material to form the composite material according to any one of Clauses 1 to 12, wherein the elastomeric material has a pre-cured viscosity of from 60,000 to 120,000 centipoise, such as 92,000 centipoise, at 20° C.

DRAWINGS

DESCRIPTION

Figure 1:
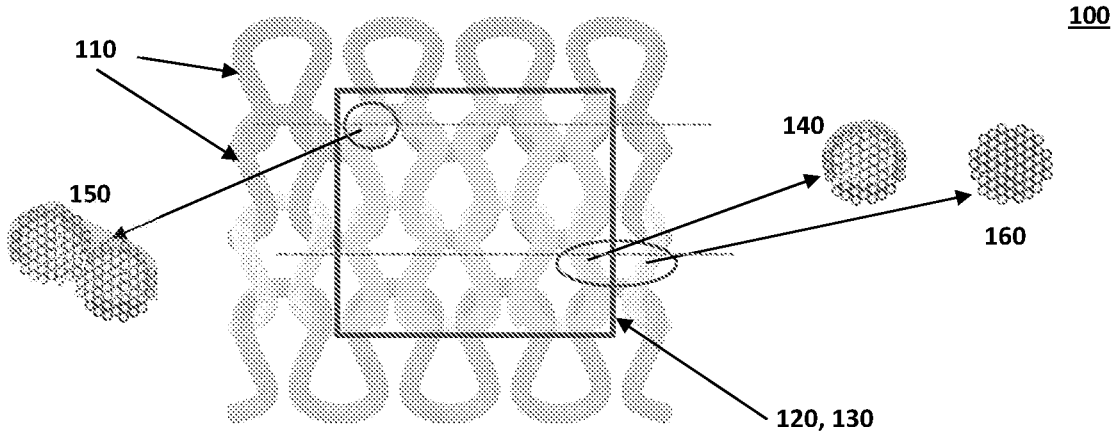
FIG. 1 depicts an embodiment of the current invention.

In a first aspect of the invention, there is provided a composite material comprising:

a textile substrate having a surface, the textile substrate formed from a yarn, where the yarn is formed from a plurality of fibres or filaments, such that the yarn has a core region of fibres or filaments surrounded by a peripheral region of fibres or filaments; and a cured elastomeric material layer laid over the whole or part of the textile substrate surface, wherein:

the cured elastomeric material penetrates into the yarn and is attached to the fibres or filaments in the peripheral region of the yarn; and the cured elastomeric material is not attached to the fibres or filaments in the core region of the yarn.

In embodiments herein, the word "comprising" may be interpreted as requiring the features mentioned, but not limiting the presence of other features. Alternatively, the word "comprising" may also relate to the situation where only the components/features listed are intended to be present (e.g. the word "comprising" may be replaced by the phrases "consists of" or "consists essentially of"). It is explicitly contemplated that both the broader and narrower interpretations can be applied to all aspects and embodiments of the present invention. In other words, the word "comprising" and synonyms thereof may be replaced by the phrase "consisting of" or the phrase "consists essentially of" or synonyms thereof and vice versa.

The phrase, "consists essentially of" and its pseudonyms may be interpreted herein to refer to a material where minor impurities may be present. For example, the material may be greater than or equal to 90% pure, such as greater than 95% pure, such as greater than 97% pure, such as greater than 99% pure, such as greater than 99.9% pure, such as greater than 99.99% pure, such as greater than 99.999% pure, such as 100% pure.

When used herein, the term "a" or "an", unless specifically stated to the contrary, are intended to cover both singular and plural. As such, the term "a yarn" may relate to the use of a single yarn or two or more (e.g. 2, 3, 4, 5, 6, 7, 8, 9 or 10) yarns.

This invention relates to a composite material formed by a textile fabric and an elastomer that is wash-durable, soft, breathable and drapable. The elastomer may form a coating on part (or the whole) of the textile substrate and the elastomeric coating may have a low-durometer hardness. The elastomer may be chosen from a group of polymers, such as liquid silicone rubber that has excellent bio-compatibility with human skin, and is chemically compatible with known textile fibre types. A surface of the fabric may be fully or partially coated with the elastomer in order to provide the composite material, with the coated sections displaying enhanced elastic modulus and reduced elongation in comparison to the uncoated sections of the textile substrate. The textile substrate may comprise textile yarns, made of a plurality of textile fibres or filaments.

The composite material disclosed herein may retain air-permeability of the substrate. For example, the composite material may have at least 20% of the air-permeability of the substrate material.

When used herein, the term "textile substrate" refers to any suitable material that may be used in the current invention. As noted hereinbefore, the textile substrate must be formed from a yarn (i.e. one or more yarns) that is formed from a plurality of fibers or filaments where each yarn has a core region of fibres or filaments and a peripheral region of fibers or filaments. Suitable textile substrates (made from the requisite yarns) include those that are a knitted fabric or a woven fabric. When used herein, the term "knitted fabric" refers to a fabric obtained by manual or machine knitting and may take any suitable form. For example, the knitted fabric may be provided so as to have one or more of single Jersey, double Jersey, tricot, and interlock stitching (as will be appreciated, the knitted fabric may be formed using only one of these stitch types or it may be formed using all of them, or any combination thereof). Any suitable woven fabrics may be used herein. Examples of a suitable fabric includes, but is not limited to a woven fabric having a stretchability of up to 50%.

Any suitable yarn may be used herein, provided that it is formed from a plurality of fibres and/or filaments. Examples of suitable yarn materials that may be mentioned herein include, but are not limited to, yarns comprising one or more materials selected from an animal fibre (e.g. a wool), and, more particularly, a polyamide (e.g. a nylon), spandex, elastane, polyester, and a cellulosic material (e.g. a cotton).

When used herein, the term "cured" means that the elastomeric material has been subjected to a reaction that results in crosslinks existing between polymer strands in the elastomeric material. The cured polymer will be solid to the touch and will not leave an adhesive residue on the finger. The cured elastomeric material may have one of more of the following properties:

(a) a Durometer shore A hardness of from 3 to 15, such as about 8;

(b) a tensile strength of from 1 to 8 Mpa, such as about 3 Mpa; and (c) an elongation to break of from 500 to 1600%, such as about 1100%.

Note that the above properties refer to the cured elastomeric material alone and not to the elastomeric material in combination with the textile substrate.

Any suitable elastomeric material that can be cured can potentially be used in the current invention. This may be a single elastomeric material or a blend of two or more (e.g. 2, 3, 4, 5 etc.) elastomeric materials that together provide a desired property or a desired set of properties.

In embodiments of the invention that may be mentioned herein, the elastomeric material may have a pre-cured viscosity of from 60,000 to 120,000 centipoise, such as 92,000 centipoise, at 20° C. In certain embodiments, the elastomeric material may be formed from blend of a first and second elastomer, where:

the first elastomer has: a pre-cured viscosity of from 100,000 to 300,000 centipoise, such as from 150,000 to 250,000 centipoise, such as about 180,000 centipoise, at a temperature of 20° C.; and the second elastomer has: a pre-cured viscosity of from 1,000 to 50,000 centipoise, such as about 3,900 centipoise, at a temperature of 20° C. Yet more particularly, the elastomeric material may be formed from blend of a first and second elastomer, where:

the first elastomer has: a pre-cured viscosity of from 100,000 to 300,000 centipoise, such as from 150,000 to 250,000 centipoise, such as about 180,000 centipoise, at a temperature of 20° C.; a Durometer shore A hardness of from 5 to 20, such as from 7 to 15, such as about 10; an elongation to break of from 500 to 2000%, such as from 1000 to 1500%; and a tensile strength of from 1 to 8 MPa, such as from 3.5 to 5 MPa; and the second elastomer has: a pre-cured viscosity of from 1,000 to 50,000 centipoise, such as about 3,900 centipoise, at a temperature of 20° C.; an Asker C hardness of from 10 to 25, such as about 17; an elongation to break of from 200 to 1500%, such as from 500 to 1,000%, such as about 750%; and a tensile strength of from 1 to 6 MPa, such as from 1.9 to 4 MPa.

A suitable elastomeric material that may be used herein is a silicone elastomer. Any suitable silicone elastomer (or silicone elastomers) may be used herein. For example, the silicone elastomer may be a blend of two or more silicone elastomers.

The silicone elastomer (or a blend of two or more silicone elastomers) may have a pre-cured viscosity of from 60,000 to 120,000 centipoise, such as 92,000 centipoise, at 20° C. Without wishing to be bound by theory, it is believed that if the silicone elastomer (or any other elastomeric material that may be used herein) has a viscosity in the above range, then it will be able to penetrate into the peripheral region of the yarn's fibres and/or filaments, but not into the core region of the fibres and/or filaments. Without wishing to be bound by theory, it is believed that when the viscosity levels are lower than 60,000 centipoise, the level of penetration of the silicone elastomer may increase to impregnate to the core of the yarn, increasing the stiffness of the yarn. Similarly, if the viscosity of the elastomer is higher than 120,000 centipoise, then the elastomer tends to remain on the surface of the fabric and does not penetrate into the peripheral region of the yarn's fibres and/or filaments, meaning that it will significantly change the fabric's surface properties.

It will be appreciated that the viscosity for other elastomers may be the same or different to that for silicone elastomers and may be readily determined by a skilled person reviewing the material produced with a microscope, or simply due to the resulting properties of the product.

In embodiments of the invention, the silicone elastomer may be formed from blend of a first and second silicone elastomer, where:

the first silicone elastomer may have:

- a pre-cured viscosity of from 100,000 to 300,000 centipoise, such as from 150,000 to 250,000 centipoise, such as about 180,000 centipoise, at a temperature of 20° C.;
- a Durometer shore A hardness of from 5 to 20, such as from 7 to 15, such as about 10;
- an elongation to break of from 500 to 2000%, such as from 1000 to 1500%; and
- a tensile strength of from 1 to 8 MPa, such as from 3.5 to 5 MPa; and the second silicone elastomer may have:

- a pre-cured viscosity of from 1,000 to 50,000 centipoise, such as about 3,900 centipoise, at a temperature of 20° C.;
- an Asker C hardness of from 10 to 25, such as about 17;
- an elongation to break of from 200 to 1500%, such as from 500 to 1,000%, such as about 750%; and
- a tensile strength of from 1 to 6 MPa, such as from 1.9 to 4 MPa.

In embodiments where the silicone elastomer is formed from blend of a first and second silicone elastomer, any suitable weight:weight ratio of the first silicone elastomer to the second silicone elastomer may be used. For example, the weight:weight ratio of the first silicone elastomer to the second silicone elastomer may be from 1:10 to 10:1, such as from 1:5 to 5:1, such as from 1:3 to 3:1, such as from 1:2 to 2:1, such as about 1:1.

As noted hereinbefore, the cured elastomeric material penetrates into the yarn and is attached to the fibres or filaments in the peripheral region of the yarn. That is, the cured elastomeric material is not found to be attached to the fibres or filaments in the core region of the yarn in any quantity (e.g. less than 5%, such as less than 2%, such as less than 1%, such as less than 0.5%, such as less than 0.1% of the cured elastomeric material penetrates and is attached to the fibres or filaments in the core region of the yarn). In certain embodiments, the cured elastomeric material is not attached to the fibres or filaments in the core region of the yarn. That is, the cured elastomeric material is not found to be attached to the fibres or filaments in the core region of the yarn at all.

The term "peripheral region" when used herein may refer to the outermost fibre and/or filament layers of a yarn that account for from 20 to 50% of the total fibres in any given cross-section of a yarn, with the remaining innermost fibres and/or filaments forming the core. Alternatively, the "peripheral region" may refer to the 1-4 outermost layers of the fibres and/or filaments, with the remainder forming the core.

As will be appreciated, the cured elastomeric material layer may be laid as a pattern over part of the textile substrate surface. As such, part of the textile substrate material may not be coated at all. Any suitable pattern may be applied to the textile substrate based on functional and aesthetic design choices desired to be present in the final product. Of course, it is possible for the entire textile substrate to be covered by the cured elastomeric material layer instead.

It is noted that the power of a portion of a composite material that is formed from the textile substrate and the cured elastomeric material layer that has not been subject to washing may increase from 20 to 500%, such as from 85 to 240%, such as from 91 to 232% compared to the power of the textile substrate alone.

When used herein, the term "power" refers to the tension of the fabric developed when it is stretched. The formula to calculate the normalized power value of the coated fabric is given below.

$$\text{Normalized power of the elastomer coated fabric} = \left(\frac{\text{power of the elastomer coated fabric}}{\text{power of the non-coated fabric}}\right) \times 100$$

In embodiments of the invention, the power of portion of a composite material formed from the textile substrate and the cured elastomeric material layer that has undergone washing to simulate at least 25 wash and dry cycles may increase from 20 to 500%, such as from 80 to 475%, such as from 85 to 230%, such as from 91 to 221% compared to the power of the textile substrate alone.

When used herein, the term "formed from the textile substrate and the cured elastomeric material layer" in relation to a portion of the composite material requires that the textile substrate of the portion is fully coated with the cured elastomeric polymer on at least one of its surfaces (i.e. on one surface). However, other components may form part of the portion that is tested if desired.

Without wishing to be bound by theory, it is believed that some or all of these properties arise from the unique structure of the composite material obtained through the careful selection of the elastomer used herein (i.e. choosing an elastomer that becomes attached to the fibres/filaments in the peripheral region of the yarn, but not to the fibres/filaments in the core region of the yarn). This is illustrated in FIG. 1, which depicts a composite material 100 according to the current invention, where a textile substrate if formed from multi-fibre/multi-filament yarns 110 that have been knitted together for the purpose of illustration. As shown, an area 120 of the textile substrate has been coated with the elastomeric material 130. As illustrated by cross-section 140, the coated area of a single yarn shows a coating on the upper surface and sides of the of the yarn, but only in the peripheral region, not the core region. A similar situation is achieved in areas where two yarns intersect each other, as illustrated by cross section 150. In contrast, the yarns in uncoated areas, as illustrated by the cross section 160 show no elastomer present.

The low-durometer elastomeric coating is partially impregnated into the outer peripheral layers of the fibres/filaments of the individual yarns where it has been applied (e.g. see 140, 150), but the interior of the yarn may be free of the elastomeric material, and a thin layer of the elastomer may remain on the surface of the yarns. Therefore, the fibers in the interior portion of the yarns are not mutually bound together by the elastomer, which prevents the yarns from becoming stiff and rigid. This, along with the low durometer-hardness of the elastomer, helps to retain important fabric properties, such as flexibility, drapability, breathability and softness. Without wishing to be bound by theory, it is believed that the partial impregnation creates mechanical interlocking of the elastomeric coating with the yarns, thereby preventing delamination of the elastomer when external strains such as elongation is applied. Additionally, at the intersection points of the yarns (e.g. see 150), the elastomeric layer may create binding points that have excellent elastic recovery after elongation. The elastomeric binding points and the rest of the elastomeric coating on the yarns may also contribute to the observed increase in power during elongation of the fabric. Also, the elastomeric binding points, the mechanical interlocking and partial penetration of the elastomer into the yarns may effectively prevent the fibre and yarn unravelling during use and washing when the coating is applied at an edge of the fabric or in the regions of the fabric where a fabric-cut edge is on a composite area/elastomer coated area. The open network of pores between the coated yarns may also enable air to permeate from one side of the fabric to the other, which is advantageous to maintain a comfortable micro-climate when worn next to body.

Colorants may be added to the elastomer to achieve desirable aesthetic features. Different functional additives can be mixed to the elastomer paste prior to the application to provide additional functional benefits such as but not limited to anti-microbial, flame-retardant, liquid repellent, far-infrared emitting, and ultra-violet ray absorption.

After the application of the elastomer paste, but before the curing process, fine particles such as polymeric powder or ceramic powder or and other functional additive powders can be temporarily adhered to the non-cured surface and create a permeant bond to the elastomer following curing. The resulting particles on the surface of the cured elastomer can be brought into direct contact with the skin of a wearer and may provide useful functionalities when in contact with the wearer's skin, such as skin enhancement, micro-circulation improvement, anti-microbial and anti-odor properties.

The areal density of the elastomeric coating (in areas to which it has been applied, may range from around 50 $g/m^2$ to around 300 $g/m^2$ depending on the fabric areal density. In other words, the coating weight percentage in areas that it is applied to may vary from 10 wt % to 100 wt % of the fabric weight depending the desired level of power increase desired.

It will also be appreciated that the material layer may include a region abutting or adjacent to a peripheral edge portion of the textile substrate surface. This peripheral edge portion may be a notional edge portion. That is, an edge portion that has not yet been realised when the elastomeric material is laid down on the textile substrate and cured, but which is only realised after this act has been completed. The realisation of the edge portion can then be achieved by cutting along the desired edge to provide a raw-cut edge. As will be appreciated, the finished edge may not require hemming, as the elastomer may protect the edge portion from unravelling or fraying during use and washing. The cutting may be realized by using a sharp blade such as a scissor, knife or using an energized method, such as using laser, ultra-sonic or radio-frequency cutting where the profile of the cut line could be a straight line or any suitable curved line, or combination thereof, as required by the design requirements of the desired product.

Figure 2:
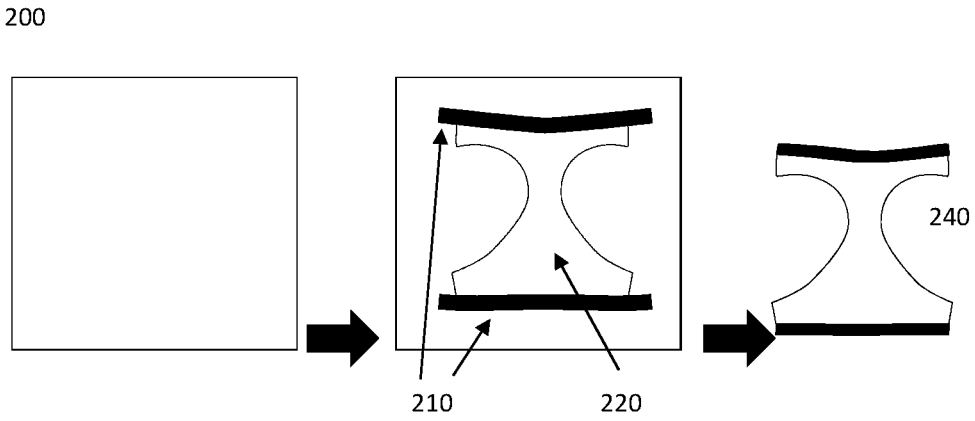
FIG. 2 depicts an embodiment of the current invention.

This process is depicted in FIG. 2, where a fabric block (200) is coated with the elastomeric material (210) along one or more notional edges of the notional garment (220) and then cured to provide the composite material in the regions to which it has been applied. This notional garment may then be cut out from the fabric block to realise the garment (240), thereby providing raw-cut edges in the garment that are protected by the elastomeric material. As will be appreciated, due to the penetration of the elastomeric material into the fabric, the raw-cut edges can be used in the final garment without the need to further secure the treated edges against the prevention of edge fraying or unravelling during use. In addition, the composite material provides the desired modulus and power enhancement on the areas of the fabric/garment to which it has been applied.

As will be appreciated, the composite material discussed hereinbefore may be used to provide the whole or part of a garment. Thus, in a further aspect of the invention, there is provided a garment comprising a composite material as described hereinbefore. As will also be appreciated, the garment may have unhemmed edges of the kind described above. That is, in certain embodiments mentioned herein, the garment may have a raw-cut edge along at least one periphery of the garment and the composite material may be present along the length of the at least one periphery with the raw-cut edge.

As will be appreciated, the composite material can provide a mild grip when used directly against skin without adding a rubbery tacky feel. As such, the composite material can be used advantageously in regions that have a higher tendency to move relative to the skin, when the wearer is engaged in activity, (e.g. to prevent ride-up of leggings or panties when walking), while providing modulus enhancement. Thus, in embodiments of the invention, there may be provided a garment in which the composite material is placed on a surface intended to be in direct contact with a wearer's skin, and is configured to grip the wearer and substantially prevent the garment from moving. For example, if the garment is in the form of a pantie, then the garment may have anti-ride-up properties on areas such as waist and leg openings.

In certain embodiments, the composite material (and hence garment) may have reduced water absorbency and enhanced modulus, which may result in a garment drying faster (e.g. swimwear). Without wishing to be bound by theory, it is believed that due to the partial impregnation of the fibres within the yarns, the number of water retention sites and capillaries in the composite material may be reduced. This may help to bring down the percentage of water uptake in the composite material regions of a garment, which may then reduce the weight of the composite material in the garment when wet and which will also increase the drying rate of at least the composite material regions of the fabric, which is beneficial for applications where direct interaction with water during the use is needed (e.g. swimwear, clothing for water sports, industrial wear) while providing the modulus and power enhancement for the desired zones of the garment that would benefit from this.

In a further aspect of the current invention, there is disclosed a method of manufacturing a composite material as described hereinbefore, the method comprising:

(a) providing a textile substrate having a surface, the textile substrate formed from a yarn, where the yarn is formed from a plurality of fibres or filaments, such that the yarn has a core region of fibres or filaments surrounded by a peripheral region of fibres or filaments; and (b) applying an elastomeric material to the surface of the textile substrate and curing the elastomeric material to form the composite material according to any one of claims 1 to 12, wherein the elastomeric material has a pre-cured viscosity of from 60,000 to 120,000 centipoise, such as 92,000 centipoise, at 20° C.

The elastomeric material may be applied in any suitable manner. For example, the elastomeric material may be applied using screen printing. The elastomeric material may be applied to cover the entirety of the textile substrate or it may be applied in any desired pattern. The method may also incorporate cutting the textile substrate through regions coated in the elastomeric material to provide raw-cut edges to a desired garment that do not need to be hemmed or otherwise treated.

Further aspects and embodiments of the invention will now be discussed by reference to the following non-limiting examples.

EXAMPLES

Silicone Formulation

Two Platinum catalyst based liquid silicone rubber formulations having the following properties listed in Table 1 were blended together in a 1:1 weight:weight ratio.

TABLE 1

| Property | Silicone 1 | Silicone 2 |
|---|---|---|
| Pre-cured Viscosity (cp) | 180,000 | 3900 |
| Hardness | 10 Shore A* | 17 Asker C** |
| Elongation at break | 1500%* | 705%** |
| Tensile strength | 3.5 MPa* | 1.9** |

*Rubber properties, measured on a 2 mm test sheet cured 10 minutes/120° C.
**Cure conditions: 5 minutes at 150° C.

The resulting blended silicone formulation had the properties listed in Table 2.

TABLE 2

| Property | Blended Silicone |
|---|---|
| Pre-cured Viscosity (cp) | ~92,000 |
| Hardness | 8 Shore A* |
| Elongation at break | ~1100%* |
| Tensile strength | ~3 MPa* |

*Rubber properties, measured on a 2 mm test sheet cured 10 minutes/120° C.
**Cure conditions: 5 minutes at 150° C.

Application Method

Screen printing of the above blended silicone formulation was conducted with 110 g/m$^2$ application weight (that is the areal density of the silicone formulation applied across the entire textile substrate) and then thermally cured onto the selected textile substrates, which are listed in Table 3 below. The weights listed below refer to the weight of the original textile before it has been treated with the elastomer.

TABLE 3

| Fabric type | Specific weight (g/m$^2$) | Composition | Knit Construction |
|---|---|---|---|
| F1 | 150 | 73% Nylon, 27% Spandex | Single Jersey |
| F2 | 120 | 72% Nylon, 28% Spandex | Tricot |
| F3 | 195 | 75% Polyester, 25% Spandex | Tricot |
| F4 | 245 | 65% Nylon, 35% Elastane | Interlock |
| F5 | 165 | 90% Cotton, 10% Spandex | Single Jersey |

Measurements

The power of the fabric with and without silicone were measured a at 60% stretch level before washing and after conducting a 60% stretch test and an accelerated laundry and drying cycle which is equivalent to 25 home laundry and tumble drying cycles.

The washing of the fabrics used a Durawash™ laboratory top loading washer. The wash cycle was conducted for 20 minutes at 55° C. with Tide™ detergent, followed by hydroextraction for 2 minutes at 600 rpm. The fabric was subsequently dried using tumble drying in a Whirlpool laboratory tumble dryer for a period of 40 minutes.

The measurements of the silicone printed fabrics before and after washing was normalized to the base fabric results, and Table 4 shows the increase in power of the fabric due to the silicone print at 60% elongation for each fabric.

TABLE 4

| Fabric | Before Wash | After Wash |
|---|---|---|
| F1 | 232% | 186% |
| F2 | 108% | 99% |
| F3 | 240% | 221% |
| F4 | 134% | 123% |
| F5 | 91% | 91% |

An air permeability test was conducted according to the test method BS 5636 (5 cm$^2$ test area and 98 Pa test pressure) for the substrates F2, F3, F5 before coating and after coating, with the results shown in Table 5.

TABLE 5

| Fabric type | Air permeability before coating (cm$^3$/cm$^2$/s) | Air permeability with coating (cm$^3$/cm$^2$/s) |
|---|---|---|
| F2 | 4.4 | 1.5 |
| F3 | 50.1 | 39.2 |
| F5 | 24.2 | 14.1 |

The invention claimed is:

1. A composite material comprising:

a textile substrate having a surface, the textile substrate formed from a yarn, where the yarn is formed from a plurality of fibres or filaments, such that the yarn has a core region of fibres or filaments surrounded by a peripheral region of fibres or filaments; and a cured elastomeric material layer laid over the whole or part of the textile substrate surface, wherein:

the cured elastomeric material penetrates into the yarn and is attached to the fibres or filaments in the peripheral region of the yarn; and the cured elastomeric material is not attached to the fibres or filaments in the core region of the yarn, wherein the cured elastomeric material is a silicone elastomer, and wherein the silicone elastomer comprises a blend of a first and a second silicone elastomer, where:

the first silicone elastomer has: a pre-cured viscosity of from 100,000 to 300,000 centipoise at a temperature of 20° C.; a Durometer shore A hardness of from 5 to 20; an elongation to break of from 500 to 2000%; and a tensile strength of from 1 to 8 MPa; and the second silicone elastomer has: a pre-cured viscosity of from 1,000 to 50,000 centipoise at a temperature of 20° C.; an Asker C hardness of from 10 to 25; an elongation to break of from 200 to 1500%; and a tensile strength of from 1 to 6 MPa.

2. The composite material according to claim 1, wherein the elastomeric material has a pre-cured viscosity of from 60,000 to 120,000 centipoise at 20° C., where:

the first silicone elastomer has: a pre-cured viscosity of from 100,000 to 300,000 centipoise at a temperature of 20° C.; and the second silicone elastomer has: a pre-cured viscosity of from 1,000 to 50,000 centipoise at a temperature of 20° C.

3. The composite material according to claim 1, wherein the cured elastomeric material has one or more of the following properties when cured:

(a) a Durometer shore A hardness of from 3 to 15;

(b) a tensile strength of from 1 to 8 Mpa; and (c) an elongation to break of from 500 to 1600%.

4. The composite material according to claim 1, wherein the weight: weight ratio of the first silicone elastomer to the second silicone elastomer is from 1:10 to 10:1.

5. The composite material according to claim 1, wherein a portion of the composite material formed from the textile substrate and the cured elastomeric material layer that has not been subject to washing has a normalized power that increases from 20 to 500% compared to the power of the textile substrate.

6. The composite material according to claim 1, wherein a portion of the composite material formed from the textile substrate and the cured elastomeric material layer that has undergone washing to simulate at least 25 wash and dry cycles has a normalized power that increases from 20 to 500% compared to the power of the textile substrate.

7. The composite material according to claim 1, wherein the cured elastomeric material layer includes a region abutting or adjacent to a peripheral edge portion of the textile substrate surface.

8. The composite material according to claim 1, wherein the cured elastomeric material layer is laid as a pattern over part of the textile substrate surface.

9. The composite material according to claim 1, wherein the yarns used in the textile substrate comprises one or more materials selected from a polyamide, spandex, elastane, polyester, an animal fibre and a cellulosic material.

10. The composite material according to claim 1, wherein the textile substrate is a knitted fabric or a woven fabric.

11. The composite material according to claim 10, wherein the knitted fabric is formed using one or more of single Jersey, double Jersey, tricot, and interlock stitching.

12. The composite material according to claim 10, wherein the woven fabric has a stretchability of up to 50%.

13. A garment comprising a composite material as described in claim 1.

14. The garment according to claim 13, wherein the garment has a raw-cut edge along at least one periphery of the garment and the composite material is present along the length of the at least one periphery with the raw-cut edge.

15. The garment according to claim 13, wherein the composite material is placed on a surface to be in direct contact with a wearer's skin, and is configured to grip the wearer without adding tackiness and substantially prevent the garment from moving.

16. A method of manufacturing a composite material according to claim 1, the method comprising:

(a) providing a textile substrate having a surface, the textile substrate formed from a yarn, where the yarn is formed from a plurality of fibres or filaments, such that the yarn has a core region of fibres or filaments surrounded by a peripheral region of fibres or filaments; and (b) applying an elastomeric material to the surface of the textile substrate and curing the elastomeric material to form the composite material according to claim 1, wherein the elastomeric material has a pre-cured viscosity of from 60,000 to 120,000 centipoise at 20° C.

* * * * *